United States Patent [19]

Grenoble

[11] Patent Number: 5,045,174

[45] Date of Patent: Sep. 3, 1991

[54] PROCESS FOR THE PRODUCTION OF HEARTCUT DISTILLATE RESIN PRECURSORS

[75] Inventor: Dane C. Grenoble, Houston, Tex.

[73] Assignee: Exxon Chemical Patents Inc., Linden, N.J.

[21] Appl. No.: 496,719

[22] Filed: Mar. 21, 1990

[51] Int. Cl.[5] ..... C10G 45/00; C10G 9/00

[52] U.S. Cl. ..... 208/57; 208/106; 208/143

[58] Field of Search ..... 208/57, 106, 67, 143

[56] References Cited

U.S. PATENT DOCUMENTS

| | | | |
|---|---|---|---|
| 3,689,401 | 9/1972 | Gomi et al. | 208/57 |
| 3,692,858 | 9/1972 | Brewer et al. | 208/57 |
| 3,844,932 | 10/1974 | Gomi | 208/57 |
| 4,022,681 | 5/1977 | Sheng et al. | 208/57 |
| 4,181,601 | 1/1980 | Sze | 208/57 |
| 4,188,281 | 3/1980 | Wernicke et al. | 208/57 |
| 4,260,474 | 4/1981 | Wernicke et al. | 208/57 |
| 4,324,935 | 4/1982 | Wernicke et al. | 208/57 |
| 4,500,416 | 2/1985 | van Dongen et al. | 208/61 |
| 4,565,620 | 10/1986 | Montgomery et al. | 208/57 |

*Primary Examiner*—Curtis R. Davis
*Assistant Examiner*—Nhat Phan
*Attorney, Agent, or Firm*—Edward F. Sherer

[57] ABSTRACT

A two-step process for the production of large quantities of heartcut distillate resin precursors from steamed cracked gas oil product which involves hydrogenation of the steam cracked gas oil followed by steam cracking of the hydrogenated product to produce a greater than 15 wt. % yield of heartcut distillate resin precursors. A process for producing heartcut distillate comprising hydrogenating a hydrocarbon oil comprising two-ring aromatic molecules to form a hydrogenated hydrocarbon oil comprising partially saturated naphthenoaromatic molecules; and subjecting a feedstock comprising hydrogenated hydrocarbon oil to steam cracking under conditions which favor producing a heartcut distillate containing an amount greater than about 4 wt. % yield of heartcut distillate resin precursors.

A method for producing heartcut distillate which involves subjecting a hydrogenated hydrocarbon feedstock boiling in the range of about 200° C. to 320° C. to steam cracking under conditions which favor producing a heartcut distillate containing an amount greater than about 4 wt. % yield of heartcut distillate (HCD) resin precursors.

A method for producing heartcut distillate which involves subjecting a hydrotreated steam cracked gas oil (SCGO) product to steam cracking under conditions which favor producing a heartcut distillate containing an amount greater than about 4 wt. % yield of heartcut distillate (HCD) resin precursors.

56 Claims, 1 Drawing Sheet

PROCESS FOR THE PRODUCTION OF HEARTCUT DISTILLATE RESIN PRECURSORS

BACKGROUND OF THE INVENTION

1. Field of the Invention

The present invention relates to a process for producing large quantities of heartcut distillate resin precursors. More particularly, the present invention is directed to a two-stage process for the production of heartcut distillate. Specifically the present invention is directed to a two-stage heartcut distillate process wherein the first stage involves hydrogenation of a hydrocarbon oil composed primarily of two-ring aromatic molecules to form large quantities of partially saturated naphtheno-aromatic molecules and the second stage involves subjecting the hydrogenated oil to a steam cracking process under conditions which favor producing a heartcut distillate containing an amount greater than 4 wt.% yield of heartcut distillate resin precursors.

2. Discussion of Background and Material Information

Heartcut distillate (HCD) resin precursors are an important and valued by-product of ethylene production by steam cracking. These precursors are reactive aromatic molecules, examples of which include styrene, vinyl-toluene, indene and methyl indene. Yields of HCD resin precursors produced by using conventional cracking processes on standard feedstocks vary from 1–4%.

Catalytic hydrogenation is a process well-known in the art used for the improvement in the petroleum refining process. It has been applied to a variety of precursor feeds that are intermediates in various stages of refining including heavy petroleum fractions, asphaltene-rich feeds, aromatic-rich fractions and dripolene light-gas oils to improve the production of hydrocarbon oil products, alkenylbenzene compounds, and other products useful to the art, for example, as disclosed in U.S. Pat. Nos. 3,689,401; 3,692,858; 3,844,932; and 4,565,620. Catalytic hydrogenation is also used prior to thermal steam cracking in a two-step process known in the art as an efficient means of producing olefins as disclosed in U.S. Pat. No. 4,188,281 light olefins, as disclosed in U.S. Pat. No. 4,500,416, and monoaromatic hydrocarbons as disclosed in U.S. Pat. No. 4,022,681.

SUMMARY OF THE INVENTION

The present invention relates to processes and methods for producing high yields of HCD resin precursors.

In general, the processes and methods for producing heartcut distillate in accordance with the present invention involve subjecting a hydrocarbon feed rich in 2-ring aromatic structures, such as a steam cracked gas oil (SCGO) product, to steam cracking under conditions which favor producing a heartcut distillate containing an amount greater than 4 wt.%, and preferably greater than 15%, yield of heartcut distillate (HCD) resin precursors, wherein the aromatic oil is hydrogenated to produce a hydrogenated naphtheno-aromatic product prior to steam cracking.

In one embodiment, the present invention is directed to a process for producing heartcut distillate which involves hydrogenating a hydrocarbon oil comprising two-ring aromatic molecules to form a hydrogenated hydrocarbon oil comprising partially saturated naphtheno-aromatic molecules; and subjecting a feedstock comprising such hydrogenated hydrocarbon oil to steam cracking under conditions which favor producing a heartcut distillate containing an amount greater than about 4 wt.% yield of heartcut distillate resin precursors.

In accordance with the present invention, the feedstock is substantially devoid of paraffinic feedstocks and the steam cracking is performed in a manner so as to substantially avoid co-feeding additional paraffinic feedstocks. Preferably, the hydrocarbon oil is an aromatic oil selected from the group consisting of steam cracked gas oil, light cat cycle oil, and light coker gas oil, and more preferably is an aromatic oil, such as a steam cracked gas oil (SCGO), having a boiling range of about 215° C. to 300° C., or wherein the two-ring aromatic molecules are selected from the group consisting of naphthalene, and naphthalene derivatives, wherein the naphthalene derivatives are selected from the group consisting of monomethylnaphthalenes and dimethylnaphthalenes, or the two-ring aromatic molecule is tetralin. Most preferably, the amount of heartcut distillate resin precursors produced by the process in accordance with the present invention is greater than 15 wt.%.

In another embodiment, the present invention is directed to a method for producing heartcut distillate which involves subjecting a hydrogenated hydrocarbon feedstock boiling in the range of about 200° C. to 320° C. to steam cracking under conditions which favor producing a heartcut distillate containing an amount greater than about 4 wt.% yield of heartcut distillate (HCD) resin precursors, preferably wherein the feedstock includes naphtheno-aromatic molecules, or has a boiling range of about 215° C. to 300° C., or is a member selected from the group consisting of steam cracked gas oil, light cat cracked oil, and light coker gas oil, and is more preferably steam cracked gas oil having 2- ring aromatic structures wherein the 2-ring aromatic structures are members selected from the group consisting of naphthalene and naphthalene derivatives, and the naphthalene derivatives are members selected from the group consisting of monomethylnaphthalenes and dimethylnaphthalenes.

In yet another embodiment, the present invention is directed to a method for producing heartcut distillate which involves subjecting a hydrotreated steam cracked gas oil (SCGO) product to steam cracking under conditions which favor producing a heartcut distillate containing an amount greater than about 4 wt.% yield of heartcut distillate (HCD) resin precursors, preferably wherein the amount of HCD is greater than 15 wt.%. In accordance with this embodiment, SCGO is hydrogenated to produce an hydrogenated SCGO product, prior to steam-cracking.

For purposes of the processes of the present invention, as described above, hydrogenation is preferably performed in the presence of a catalyst, such as a noble metal catalyst on a support, eg. $Al_2O_3$, or a bimetallic catalyst which is composed of at least one metal selected from Group VI of the Periodic Table and at least one metal selected from Group VIII of the Periodic Table, preferably wherein the metal from Group VI is selected from the group consisting of molybdenum and tungsten, which is preferably sulfided. Preferably, the hydrogenating is performed at a temperature within the range of about 500°–750°; under a pressure within the range of 250–2,500 psig, in the presence of hydrogen within the range of about 500–5,000 SCF/bbl; at a liquid hourly space velocity within the range of about 0.1–3.0 V/H/V, and the conditions of steam-cracking comprise temperatures greater than 1300° F., which are preferably within the range of about 1400° F. 1800° F., and more preferably, are within the range of about 1400° F. to 1600° F. In accordance with the present invention, the conditions of steam-cracking include steam present in a ratio of about 0.1: to 2.0:1 steam to hydrocarbon, and a residence time of in the range of about 0.1 to 1.0 second.

BRIEF DESCRIPTION OF THE DRAWING

The Figure annexed hereto is a flow diagram of a process in accordance with the present invention.

DETAILED DESCRIPTION

Figure 1:
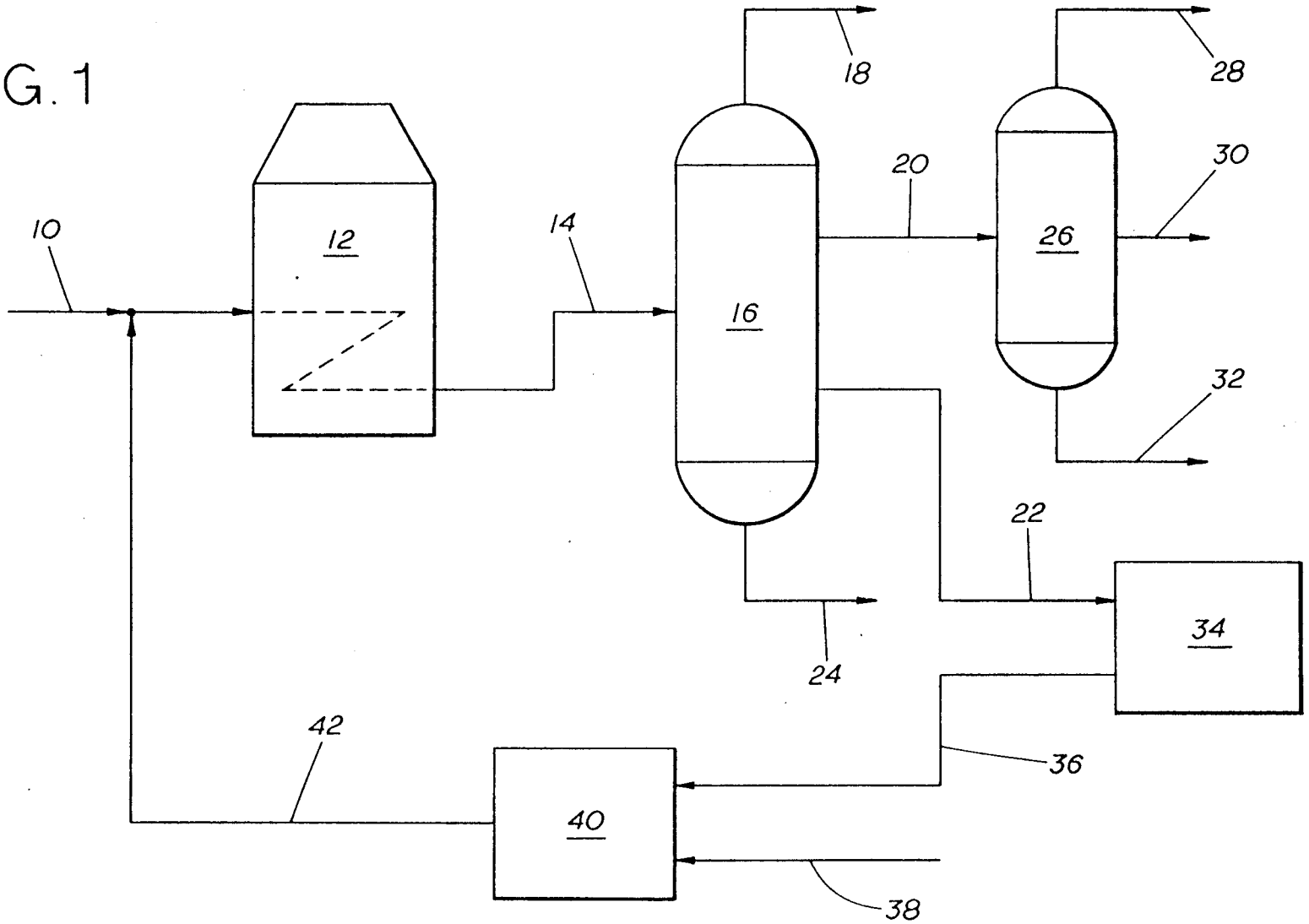

In accordance with the present invention, a two-step process has been developed which, when applied to steam-cracked gas oils (SCGO), produces greater than 15 wt.% yields of HCD resin precursors.

The first step of the process in accordance with the present invention involves the catalytic hydrogenation of an aromatic feed suitable for hydrogenation to form naphtheno-aromatics. A particularly useful aromatic feed suitable for hydrogenation to form naphtheno-aromatics is steam cracked gas oil (SCGO) product normally having a boiling range of about 215° C. to about 300° C. and is rich in 2-ring aromatic structures, including naphthalene and its derivatives, such as mono and dimethylnaphthalenes. Other potentially useful aromatic rich feeds include the appropriate boiling range material from catalytic (cat) cracking and coking processes. These streams are typically referred to as light cat cycle oil and light coker gas oil. Although conventional in the art as used herein "light cat cycle oil" is that product stream boiling in the range of about 200° C. to 340° C. obtained from the cat cracking of hydrocarbon oils as widely practiced in the petroleum refining industry. The chemistry of the cat cracking process results in the production of high aromatic content liquid products boiling above 200° C. which are useful precursors for the process to make HCD described herein. Another petroleum refining process which results in the production of high aromatic content oils is the coking process. The liquid product from the coking process boiling in the range of about 200° C. to 340° C. is typically referred to as light coker gas oil and is also a useful hydrocarbon precursor stream for the production of HCD by the process claimed herein.

This hydrogenation is performed using conventional technology and yields a liquid product with high concentrations of naphthenoaromatic molecules, such as tetralin.

The hydrogenation catalyst employed should be suitable for effecting partial saturation of aromatics to form naphtheno- aromatics. Typically, therefore, the hydrogenation catalyst is bimetallic containing at least one metal from Periodic Table Group VI and at least one metal from Periodic Table Group VIII, but may contain other metals. In a preferred form, the Group VI metal is molybdenum or tungsten, the Group VIII metal is cobalt or nickel, and the catalyst is sulfided. In a more preferred form, the catalyst is sulfided Ni:$MoAl_2O_3$.

The hydrogenation step is performed at a temperature within the range of 400° F.–950° F., and preferably at 500° F.–750° F. with 550° F. to 650° F. being more preferred. The pressure used is within the range of 250–2500 psig, preferably 400–600 p.s.i.g. Hydrogen is used at 200–15,000 SCF/bbl, preferably from 500–3000 SCF/bbl, and most preferably 1000 to 2000 SCF/bbl. The liquid hourly space velocity is 0.1–3.0 V/H/V, preferably from 0.8–2.0 V/H/V and most preferably 1.0 to 1.5 V/H/V.

The hydrogenation process described above is well known technology and many variations of process conditions and catalyst selection are routinely practiced within the petroleum and chemical industries. The publication entitled "Catalytic Processes and Proven Catalysts" by C. L. Thomas (Academic Press, New York, 1970) is one of many references one can use to define catalysts and conditions useful to perform the desired partial saturation of aromatic molecules useful for the production of hydrogen donor diluent (HCD) molecules as described herein.

In the second step, the resultant feedstock is subjected to a conventional steam-cracking process. The steam cracking process to produce light olefins and concomitant by-products, such as HCD, used for purposes of the present invention may be any of the well known conventional processes, notwithstanding that steam cracking process conditions and feedstocks vary considerably depending on plant location and feedstock availability. Thus, the process of the present invention as applied to steam cracking processes as described herein to produce heartcut distillate is particularly advantageous because the present invention is completely compatible with existing commercial plant operations and can be effected easily within the process capabilities of any steam cracking plant capable of feeding naphtha and/or gas oil feedstocks. A steam cracking process suitable for use in accordance with the present invention is described in the publication entitled "Manufacturing Ethylene" by S. B. Zdonik et al. (Oil and Gas Journal). As described, steam cracking may be performed at temperatures greater than 1300° F., preferably 1400° F.–1700° F., and most preferably 1400° F. to 1650° F., with steam present in a steam to hydrocarbon ratio of 0.1:1 to 2.0:1. Residence time for the cracking reaction is typically in the range of about 0.01 to about 5 seconds and preferably in the range of about 0.1 to about 1 second. Typical feeds for conventional liquid steam crackers are virgin and hydrotreated liquid feedstocks ranging from light naphthas to heavy vacuum gas oils. For the present invention, feedstocks boiling in the range of 200° C. to 320° C. and rich in naphtheno-aromatic molecules are preferred steam cracker feeds to produce HCD product in amounts greater than about 4% and preferably greater than 15 wt.% based on the hydrocarbon feed to the steam cracking process.

The process for the present invention will be described in reference to the attached FIG. 1. The process, in general, is conventional steam cracking of hydrocarbons to produce light olefins and a myriad of by-products including heart-cut distillate. Feedline 10 supplies the feedstock to a conventional steam cracking furnace 12. The effluent from the furnace is cooled prior to introduction into a series of recovery distillation towers. Tower 16 is normally referred to as the primary fractionator and is used to separate the $C_4$ minus gases through line 18 from the liquid by-products. Line 20 is used to recover light liquid products having a boiling range from about 60° C. to 220° C. A heart-cut fraction boiling from about 160° C. to 220° C. from this stream can be recovered via line 30 by subsequent fractionation in a tower 26. The next heavier cut normally recovered via line 22 is a steam cracked gas oil (SCGO) product with a typical boiling range of about 220° C. to 300° C. In the present invention, this cut is stored in tank 34 and subsequently fed via line 36 to a conventional hydrofiner 40 for conversion of the mainly two ring aromatics contained in the SCGO cut to naphtheno-aromatics. In another embodiment of this invention, external aromatic rich feeds from, for example, cat crackers or cokers can be fed to the hydrofiner via line 38. The effluent from the hydrofiner is then fed to the steam cracker via line 42 for cracking to produce a product having a large quantity of heartcut distillate product 30.

The final product of this process contains greater than 4 wt.% and preferably greater than 15 wt.% HCD resin precursors.

EXAMPLES

In the following examples, the steam cracking pyrolysis yields were obtained using a laboratory test apparatus which has been shown to give yield patterns similar to that obtained in commercial steam cracking processes. The heart-cut distillate (HCD) product described in the following examples is represented by the summation of the respective yields of styrene, vinyltoluenes, indene and methyl-indenes contained in the $C_5$ plus liquid product from the steam cracking process.

EXAMPLE 1

In this example, two pyrolysis yield patterns are presented for two different gas oil feedstocks typical to that which may be used as commercial feedstocks. Feed No. 1 is a gas oil that has not been subjected to hydrofining, whereas Feed No. 2 is the hydrofined equivalent gas oil after being subjected to hydrodesulfurization using a conventional hydrofining process. This example compares the pyrolysis yield patterns of commonly used liquid feedstocks in the steam cracking process, and also compares the yield effects of hydrofining of conventional feedstocks relative to un-hydrofined feedstocks. The selected yields presented in the following table were obtained using a simple laboratory apparatus, as described below, which has been shown to give yield patterns comparable to yield patterns that are obtained in commercial steam cracking processes.

The apparatus used in accordance with the present invention is a continuous flow tubular reactor in which hydrocarbon feed is mixed with inert gas diluent and then preheated in the first part of the reactor to about 500° C. and then passed through the high temperature cracking zone, which is typically held in the range of about 700° C. to 900° C., to effect the cracking reactions to produce the desired light olefin products as well as the desired by-products, such as HCD. Conditions are selected to control the conversion and product selectivities desired. For one skilled in the art of steam cracking chemistry, such a unit can be used to study a wide range of possible feedstocks and conditions useful for modeling the steam cracking process. The apparatus used to produce the data presented in this and the following examples has been shown to produce yield results comparable to that observed in production line-scale plants and is thus a useful research tool to model the production line-scale process.

TABLE 1

| PRODUCT: | YIELD, WT. % ON FEED Feed No.: 1 | 2 |
|---|---|---|
| Ethylene | 19.65 | 21.19 |
| Propylene | 11.94 | 12.36 |
| Sum $C_4$ minus | 54.24 | 57.05 |
| Sum $C_5$ plus | 45.76 | 42.95 |
| SCN ($C_5$ to 430° F.) | 19.01 | 22.29 |
| SCGO (430° F. to 525° F.) | 5.22 | 3.73 |
| SCT (525° F. plus) | 21.53 | 16.93 |
| Sum HCD | 3.16 | 3.30 |

The yield data indicates, in one case, the advantage of hydrofining steam cracker feedstocks, i.e., the yields from the hydrofined feed (No. 2) of valuable $C_4$ minus gas and SCN liquid products are enhanced relative to the products from the un-hydrofined feedstock (No. 1). This demonstrates a known advantage for hydrofining feedstocks for the steam cracking process. However, the yield data also indicates that little advantage is gained by hydrofining for the production of HCD product. The yields of valuable HCD molecules are essentially equivalent for these two feeds. Thus, this example demonstrates the significant advantage of the present invention in producing large quantities of desirable heart-cut distillate resin precursors.

EXAMPLE 2

In this example, a comparison of pyrolysis yields from two model compounds has been made in order to demonstrate the importance of using feedstocks rich in naphtheno- aromatics in the production of large quantities of HCD product by steam cracking. In the following table, selected yields from cracking the model compounds, tetralin (1, 2, 3, 4-tetrahydronaphthalene) and decalin (decahydronaphthalene), are compared. The yields obtained by cracking these two model compounds were about 95%. These results were obtained in the same laboratory apparatus and procedure used in example 1.

TABLE 2

| PRODUCT: | YIELD, WT. % ON FEED Model Feed: Tetralin | Decalin |
|---|---|---|
| Ethylene | 3.20 | 18.27 |
| Propylene | 0.20 | 6.55 |
| Sum $C_4$ minus | 7.82 | 43.25 |
| Sum $C_5$ plus | 92.18 | 56.75 |
| SCN (430° F. minus) | 91.02 | 56.75 |
| SCGO (430° F. plus) | 1.16 | 0.00 |
| Sum HCD | 22.96 | 3.75 |

The yields from these two model compounds are markedly different. The fully saturated compound, decalin, cracks to a yield slate not too dissimilar from the yields presented in Example 1 which are typical of normal liquid feedstocks for steam cracking. In contrast, the partially saturated naphtheno-aromatic compound, tetralin, has a significantly different yield pattern. As can be seen in the above table, tetralin cracks to very little $C_4$ minus ($C_4$-)product, but makes a significant amounts of valuable HCD product. This example demonstrates the value of steam cracking naphtheno-aromatic molecules to produce high yields of HCD molecules. Also, tetralin makes significantly more HCD product than either of the typical steam cracker feedstocks described in example 1.

EXAMPLE 3

In the following table selected yields from the cracking of three model feeds are compared. All three feeds were cracked under identical reaction conditions in the same apparatus as used in examples 1 and 2. The first feed is the paraffin, n-heptane. The second feed is tetralin and the third feed is an admix of these two feeds with the composition of 75% n-heptane and 25% tetralin. Also included in the table are the yields calculated by linearly blending the yields from cracking pure n-heptane and tetralin in the 75/25 feed ratio and the apparent yield from tetralin in the admixture if the n-heptane yields are backed out of the admixed yield slate.

TABLE 3

| | YIELD, WT. % ON FEED Yield Slate No.: | | | | |
|---|---|---|---|---|---|
| Product: | 1 | 2 | 3 | 4 | 5 |
| Ethylene | 36.40 | 2.82 | 28.01 | 29.86 | 10.24 |
| Propylene | 16.89 | 0.24 | 12.73 | 14.09 | 5.69 |
| Total $C_4$ minus | 79.98 | 7.42 | 61.84 | 67.38 | 29.58 |
| Total $C_5$ plus | 20.02 | 92.58 | 38.16 | 32.62 | 70.42 |
| Total HCD | 1.00 | 24.46 | 6.87 | 3.30 | 10.20 |

Note: In above Table the yield slates are identified as follows:

Yield slate No. 1: 100% n-heptane feed.

Yield slate No. 2: 100% tetralin feed.

Yield slate No. 3: Calculated linear blend of n-heptane and tetralin assuming there is no interrelated chemical effects due to the simultaneous cracking of the two reactants. Calculated by multiplying yield from n-heptane (Yield slate No. 1) by 0.75 and adding yield from tetralin (Yield slate No. 2) multiplied by 0.25.

Yield slate No. 4: Actual admix yields from cracking a mixture of 75% n-heptane and 25% tetralin.

Yield slate No. 5: Calculated apparent yields of tetralin if weighted yields from n-heptane (Yield slate No. 1) are backed out of the measured yields of the admix feed (Yield slate No. 4) and the yields are then renormalized to 100%.

In the above table, Yield Slate No. 3 represents the expected weight-averaged yields if the two reactants, n-heptane and tetralin, were to chemically crack according to their respective yield patterns when cracked pure. However, when the actual yields obtained by admix cracking (Yield slate 4) are compared to the calculated hypothetical yields (Yield slate 3), it is evident that substantial effects on the cracking chemistry occur due to the admix cracking process. In particular, the measured results show significantly more $C_4$ minus product formed by admix cracking then expected if no synergistic effects occur due to the co- cracking of the two reactants. Also, admix cracking produces less than 50% of the expected HCD product (3.30% vs. expected 6.87%). The admix Yield Slate No. 4) approaches that normally seen with typical liquid steam cracker feeds as seen by comparing yield slate No. 4 with the yields presented in example 1 above. A comparison of the calculated apparent yield slate (No. 5) from the tetralin portion of the admixture to the pure tetralin yield slate (No. 2) clearly shows the dramatic effect of co-cracking a naphtheno-aromatic molecule with a hydrogen rich molecule like n- heptane. Co-cracking results in much greater formation of ethylene and propylene and other $C_4$ minus light products and significantly less $C_5$ plus product including HCD product.

This example demonstrates that the yield of HCD product as well as the entire yield slate from cracking naphtheno-aromatic feeds can be influenced by admix cracking naphtheno-aromatic with more paraffinic feeds.

This example also demonstrates the unexpected importance of segregated cracking of naphtheno-aromatic feedstocks if high yields of HCD product are desired. This example also illustrates that the product distribution from cracking naphtheno-aromatic feeds can be selectively controlled by co-cracking these feeds with hydrogen rich feeds, such as paraffins, when less HCD and other $C_5$ ($C_5$+) plus molecules are desired. This example illustrates a general advantage for co-cracking a hydrogen deficient feedstock with a hydrogen rich feedstock, to result in high yields of light products when desired.

EXAMPLE 4

This Example is directed to a two-step process to produce first a feedstock rich in naphtheno-aromatic molecules and then in a second step to steam crack this feed to produce large quantities of HCD product. In a typical steam cracking process, a by-product of the desired cracking reactions to form light olefins, such as ethylene and propylene, is a $C_5$+liquid fraction of broad boiling range. This liquid product is known to be highly aromatic in nature. The liquid product, which boils in the range of about 215° C. to 300° C., is known to contain large quantities of two ring aromatics, such as naphthalene and substituted naphthalenes, e.g. methylnaphthalenes. This boiling range material is herein referred to as steam cracked gas oil (SCGO). SCGO is an ideal feed source for producing naphtheno- aromatics by conventional hydrotreating processes. For this example, SCGO was obtained from a commercial steam cracker located in Cologne, West Germany and subjected to a hydrotreating process to produce a feedstock rich in naphtheno-aromatic molecules. For example, the hydrotreated SCGO contained abut 30% tetralin which was formed by the hydrogenation of contained naphthalene during the hydrotreatment process.

The conditions for this particular hydrotreating procedure were as follows: reactor pressure (38 barg); inlet temperature (335° C.); LHSV (1.0 $hr^{-1}$); and hydrogen to oil ratio hydrotreating step was sulfided $NiMoAl_2O_3$, which is a standard, well-known catalyst useful to effect hydrotreating reactions. Notwithstanding the use of such conditions, however, there are a wide range of process conditions and catalysts known by those skilled with hydrotreating processes which are suitable to hydrogenate aromatic molecules to produce predominately the partially hydrogenated naphtheno-aromatic and the above conditions and catalyst choice should thus not be considered restrictive to the purpose of this invention. At the previously described conditions, the hydrotreating step increased the hydrogen content of the SCGO feed by 2.4%.

In a second step the hydrogenated SCGO was subjected to steam cracking reactions in the same reactor apparatus used in the previous examples. Following are selected yields from this study.

TABLE 4

| PRODUCT: | YIELD, WT. % ON FEED Hydrogenated SCGO Feed: Run 1 | Run 2 |
|---|---|---|
| Ethylene | 9.28 | 9.89 |
| Propylene | 4.83 | 5.14 |
| Sum $C_4$ minus | 27.44 | 29.19 |
| Sum $C_5$ plus | 72.56 | 70.81 |
| SCN (430° F. minus) | 49.08 | 49.74 |
| SCGO (221° C. to 300° C.) | 20.21 | 18.77 |
| SCT (300° C. plus) | 3.27 | 2.30 |
| Sum HCD | 18.12 | 18.62 |

The above table indicates that a hydrogenated aromatic stream, such as hydrogenated SCGO, is an excellent steam cracking feedstock if high yields of HCD product are desired. An HCD yield of over 18% is significantly higher than the approximately 3% yield obtained with conventional steam cracker feeds as shown in yields as shown in example 1.

This example demonstrates a two-step process in which a highly aromatic stream containing predominantly 2-ring aromatic molecules which, in the first step, is hydrotreated to form a large concentration of naphtheno-aromatic molecules and in the second step, is steam cracked to result in a final product slate from the two-step process that is rich in HCD product.

It is further understood that although the invention has been specifically described with reference to particular means and embodiments, the foregoing description is that of preferred embodiments of the invention. The invention, however, is not limited to the particulars disclosed but extends to all equivalents, and various changes and modifications may be made to the invention without departing from the spirit and scope thereof. Thus, numerous modifications and variations of the present invention are possible in light of the above teachings and, there, within the scope of the appended claims the invention may be practiced otherwise than as particularly described.

What is claimed is:

1. A process for producing heartcut distillate comprising:

a) hydrogenating a hydrocarbon oil comprising two-ring aromatic molecules to form a hydrogenated hydrocarbon oil comprising partially saturated naphtheno-aromatic molecules; and b) subjecting a feedstock comprising said hydrogenated hydrocarbon oil to steam cracking under conditions which favor producing a heartcut distillate containing an amount greater than about 4 wt.% yield of heartcut distillate resin precursors.

2. The process as defined by claim 1, wherein said feedstock is substantially devoid of paraffinic feedstocks.

3. The process as defined by 2, wherein said steam cracking is performed in a manner so as to substantially avoid co-feeding additional paraffinic feedstocks.

4. The process as defined by claim 1, wherein said hydrocarbon oil is an aromatic oil selected from the group consisting of steam cracked gas oil, light catalytic cycle oil, and light coker gas oil.

5. The process as defined by claim 4, wherein said aromatic oil is a steam cracked gas oil (SCGO).

6. The process as defined by claim 5, wherein said steam cracked gas oil has a boiling range of about 215° C. to 330° C.

7. The process as defined by claim 5, wherein said two-ring aromatic molecules are selected from the group consisting of naphthalene, and naphthalene derivatives.

8. The process as defined by claim 7, wherein said naphthalene derivatives are selected from the group consisting of monomethylnaphthalenes and dimethylnaphthalenes.

9. The process as defined by claim 7, wherein said two-ring aromatic molecules comprise tetralin.

10. The process as defined by claim 1, wherein said amount of heartcut distillate resin precursors is greater than 15 wt.%.

11. The process of claim 1, wherein said hydrogenating is performed in the presence of a catalyst.

12. The process of claim 11, wherein said catalyst is bimetallic.

13. The process of claim 12, wherein said bimetallic catalyst comprises at least one metal selected from Group VI of the Periodic Table and at least one metal selected from the Group VIII of the Periodic Table.

14. The method of claim 13, wherein said metal from Group VI is selected from the group consisting of molybdenum and tungsten.

15. The method of claim 13, wherein said metal selected from Group VIII is selected from the group consisting of cobalt and nickel.

16. The method of claim 14, wherein said catalyst is sulfided.

17. The method of claim 16, wherein said catalyst is a sulfided $NiMoAl_2O_3$ catalyst.

18. The method of claim 5, wherein said hydrogenating is performed at a temperature within the range of about 500° F.–750° F.; under a pressure within the range of about 250–2,500 psig, in the presence of hydrogen within the range of about 500–5,000 SCF/bbl; at a liquid hourly space velocity within the range of about 0.1–3.0 V/H/V.

19. The process as defined by claim 5, wherein said conditions of steam-cracking comprise temperatures greater than about 1300° F.

20. The process as defined by claim 19, wherein said temperatures are within the range of about 1400° F.–1800° F.

21. The process as defined by claim 20, wherein said temperatures are within the range of about 1400° F. to 1650° F.

22. The process as defined by claim 19, wherein said conditions of steam-cracking comprise steam present in a ratio of about 0.1: to 2.0:1 steam to hydrocarbon.

23. The process as defined by claim 22, wherein said conditions of steam-cracking further comprise a residence time of in the range of about 0.1 to 1.0 second.

24. A method for producing heartcut distillate comprising:

subjecting a hydrogenated hydrocarbon feedstock comprising naphtheno-aromatic molecules boiling in the range of about 200° C. to 320° C. to steam-cracking under conditions which favor producing a heartcut distillate containing an amount greater than about 4 wt. % yield of heartcut distillate (HCD) resin precursors.

25. The method of claim 24, wherein said hydrogenated hydrocarbon feedstock has a boiling range of about 215° C. to 300° C.

26. The method of claim 24, wherein said hydrocarbon feedstock is a member selected from the group consisting of steam cracked gas oil, light catalytic cracked oil, and light coker gas oil.

27. The method of claim 26, wherein said hydrocarbon feedstock is steam cracked gas oil.

28. The method of claim 27, wherein said steam cracked gas oil comprises 2-ring aromatic structures.

29. The method of claim 28, wherein said 2-ring aromatic structures are members selected from the group consisting of naphthalene and naphthalene derivatives.

30. The method of claim 29, wherein said naphthalene derivatives are members selected from the group consisting of monomethylnaphthalenes and dimethylnaphthalenes.

31. The process as defined by claim 24, wherein said conditions of steam-cracking comprise temperatures greater than 1300° F.

32. The process as defined by claim 31, wherein said temperatures are within the range of about 1400° F.-1800° F.

33. The process as defined by claim 32, wherein said temperatures are within the range of about 1400° F. to 1650° F.

34. The process as defined by claim 224, wherein said conditions of steam-cracking comprise steam present in a ratio of about 0.1: to 2.0:1 steam to hydrocarbon.

35. The process as defined by claim 34, wherein said conditions of steam-cracking further comprise a residence time of in the range of about 0.1 to 1.0 seconds.

36. The process as defined by claim 24, wherein said hydrocarbon feedstock is produced by hydrogenating a hydrocarbon feed in the presence of a catalyst.

37. The process of claim 36, wherein said catalyst is bimetallic.

38. The process of claim 37, wherein said bimetallic catalyst comprises at least one metal selected from Group VI of the Periodic Table and at least one metal selected from Group VIII of the Periodic Table.

39. The method of claim 38, wherein said metal from Group VI is selected from the group consisting of molybdenum and tungsten.

40. The method of claim 39, wherein said metal selected from the Group VIII is selected from the group consisting of cobalt and nickel.

41. The method of claim 39, wherein said catalyst is sulfided.

42. The method of claim 41, wherein said catalyst is a sulfided $NiMoAl_2O_3$ catalyst.

43. The method of claim 36, wherein said hydrogenating is performed at a temperature within the range of about 500°-750° F.; under a pressure within the range of 250-2,500 psig, in the presence of hydrogen within the range of about 500-5,000/SCF/bbl; at a liquid hourly space velocity within the range of about 0.1-3.0 V/H/V.

44. A method for producing heartcut distillate comprising subjecting a hydrotreated steam cracked gas oil (SCGO) product comprising naphtheno- aromatic molecule to steam cracking under conditions which favor producing a heartcut distillate containing an amount greater than about 4 wt.% yield of heartcut distillate (HCD) resin precursors.

45. The method of claim 44, wherein said amount of HCD is greater than 15 wt.%.

46. The method of claim 45, comprising hydrogenating SCGO to produce an hydrogenated SCGO product, prior to said steam- cracking.

47. The method of claim 46, wherein said hydrogenating is performed at a temperature within the range of about 500° F.-750°; under a pressure within the range of 250-2,500 psig, in the presence of hydrogen within the range of about 500-5,000 SCF/bbl; at a liquid hourly space velocity within the range of about 0.1-3.0 V/H/V.

48. The method of claim 44, wherein said naphthenoaromatic molecules comprise tetralin.

49. The method of claim 46, wherein said hydrogenation is performed in the presence of a catalyst.

50. The method of claim 49, wherein said catalyst is bimetallic.

51. The method of claim 50, wherein said bimetallic catalyst comprises at least one metal selected from Group VI of the Periodic Table and at least one metal selected from Group VIII of the Periodic Table.

52. The method of claim 51, wherein said metal from Group VI is selected from the group consisting of molybdenum and tungsten.

53. The method of claim 51, wherein said metal selected from Group VIII is selected from the group consisting of cobalt and nickel.

54. The method of claim 52, wherein said metal from Group VI is selected from the group consisting of molybdenum and tungsten.

55. The method of claim 54, wherein said catalyst is sulfided.

56. The method of claim 55, wherein said catalyst is a sulfided $NiMoAl_2O_3$ catalyst.

* * * * *